US009556625B2

(12) United States Patent
Meldner et al.

(10) Patent No.: US 9,556,625 B2
(45) Date of Patent: Jan. 31, 2017

(54) SUSPENDED SCAFFOLDING SYSTEM

(76) Inventors: Jerzy Meldner, Exmouth (GB); Krzysztof Meldner, Warsaw (PL)

( * ) Notice: Subject to any disclaimer, the term of this patent is extended or adjusted under 35 U.S.C. 154(b) by 0 days.

(21) Appl. No.: 14/003,630

(22) PCT Filed: Mar. 8, 2012

(86) PCT No.: PCT/IB2012/051092

§ 371 (c)(1),
(2), (4) Date: Sep. 6, 2013

(87) PCT Pub. No.: WO2012/120471

PCT Pub. Date: Sep. 13, 2012

(65) Prior Publication Data

US 2013/0341125 A1 Dec. 26, 2013

(30) Foreign Application Priority Data

Mar. 8, 2011 (GB) ..... 1103876.7

(51) Int. Cl.

| | |
|---|---|
| ***E01D 19/10*** | (2006.01) |
| ***E04G 3/00*** | (2006.01) |
| ***E04G 3/28*** | (2006.01) |
| ***E04G 3/34*** | (2006.01) |

(52) U.S. Cl.

CPC ..... *E04G 3/00* (2013.01); *E01D 19/106* (2013.01); *E04G 3/28* (2013.01); *E04G 3/34* (2013.01)

(58) Field of Classification Search

CPC ..... E01D 19/106; E04G 3/00; E04G 3/34; E04G 3/38; E04G 2003/283; B66F 11/04

(Continued)

(56) References Cited

U.S. PATENT DOCUMENTS 2,925,240 A 2/1960 LaViolette
3,608,669 A * 9/1971 Lindsay, Jr. ..... 182/14

(Continued)

FOREIGN PATENT DOCUMENTS

CH 262 727 A 7/1949
DE 23 65 076 A1 7/1975

(Continued)

OTHER PUBLICATIONS

International Search Report for PCT/IB2012/050192, mailed Oct. 24, 2012; ISA/EP.

(Continued)

*Primary Examiner* — Daniel Cahn
(74) *Attorney, Agent, or Firm* — Harness, Dickey & Pierce, PLC

(57) ABSTRACT

A suspended scaffolding system (100) including a connector system (32,33) adapted to engage a track (31) which in use is in contact with the surface of a structure (30), an arm (34, 39) connects the suspended scaffolding system to the connector system, so in use the suspended scaffolding system is suspended below the structure. In a first embodiment, the connector system has connectors that permit relative movement with respect to the track in two orthogonal planes. In a second embodiment a moveable counterweight (37) is provided on the suspended scaffolding system, adapted to be displaced from a first position to a second position to change the center of gravity of the suspended scaffolding system. In a third embodiment, a track connector system is provided comprising at least three fasteners each of which is in contact with the track and adapted to be temporarily removed from the track to permit the suspended scaffolding system to negotiate obstacles.

6 Claims, 14 Drawing Sheets

(58) Field of Classification Search
USPC ..... 182/150, 36, 129
See application file for complete search history.

(56) References Cited

U.S. PATENT DOCUMENTS

| | | | | |
|---|---|---|---|---|
| 3,708,038 | A * | 1/1973 | Ewing, Jr. | 182/150 |
| 3,774,719 | A * | 11/1973 | Lindsay, Jr. | 182/2.6 |
| 3,854,550 | A * | 12/1974 | Shingler | 182/36 |
| 4,154,318 | A | 5/1979 | Malleone | |
| 4,496,027 | A * | 1/1985 | Fisher | 182/142 |
| 4,828,073 | A * | 5/1989 | Friday | 182/36 |
| RE36,649 | E * | 4/2000 | Jefferies et al. | 15/50.1 |
| 8,347,580 | B2 * | 1/2013 | Beeche | 52/697 |
| 2004/0020138 | A1 * | 2/2004 | Grearson | 52/64 |
| 2009/0020361 | A1 * | 1/2009 | Teichert | 182/36 |
| 2009/0114478 | A1 * | 5/2009 | Hamilton et al. | 182/5 |
| 2012/0090917 | A1 * | 4/2012 | Teichert | 182/14 |

FOREIGN PATENT DOCUMENTS

| | | | |
|---|---|---|---|
| DE | 3 115 239 | A1 | 11/1982 |
| DE | 3 124 183 | A1 | 12/1982 |
| DE | 19526964 | A1 | 1/1997 |
| DE | 1 96 37 543 | A1 | 3/1998 |
| DE | 298 17 277 | U1 | 2/2000 |
| DE | 202008015147 | U1 | 4/2010 |
| EP | 0 874 084 | A1 | 10/1998 |
| EP | 0 930 408 | A1 | 7/1999 |
| FR | 2 845 715 | A1 | 4/2004 |
| GB | 1 517 560 | A | 7/1978 |
| GB | 2 465 985 | A | 6/2010 |
| JP | H-07158257 | A | 6/1995 |
| JP | H-07217189 | A | 8/1995 |
| JP | H-07217190 | A | 8/1995 |
| JP | 2005 232773 | A | 9/2005 |
| WO | WO-00/77323 | A1 | 12/2000 |
| WO | WO-2009/125070 | A1 | 10/2009 |

OTHER PUBLICATIONS

Combined Search and Examination Reports from the Intellectual Property Office of the United Kingdom for Priority Application GB 1 103 876.7.

* cited by examiner

W
212
214
112
220
114
120
124
128

30
30
128
28
110
111
144
146
310
140
142

SUSPENDED SCAFFOLDING SYSTEM

CROSS-REFERENCE TO RELATED APPLICATIONS

This application is a 371 U.S. National Stage of International Application No. PCT/IB2012/051092, filed Mar. 8, 2012, and claims priority to British Patent Application No. 1103876.7, filed Mar. 8, 2011, the disclosures of which are herein incorporated by reference in their entirety.

FIELD OF THE INVENTION

This invention relates to a scaffolding system. Particularly, but not exclusively, the invention relates to a suspended scaffolding system, for example of the type for use in the construction, inspection and maintenance of structures, in particular spanning structures.

Although reference has been made to spanning structures, it is understood that the invention may be used in the construction, inspection and maintenance of many other different types of structures such as: buildings, tunnels, elevated roadways, walkways, aqueducts, and other similar civil engineering undertakings.

BACKGROUND OF THE INVENTION

Many different structures span across a distance of for example, ten or more meters, including bridges and viaducts. These structures require temporary access from beneath during construction, inspection and maintenance routines, however access can be difficult. One method of access is to build a temporary scaffold from the ground up but this is unfeasible in many circumstances. Another method is to build a walkway or gantry whilst the structure is being built, however this increases costs at that stage, requires foresight and also may require security to prevent unauthorised access of the gantry.

It has therefore been recognised for a long time that a temporary structure, that is cheap and easy to deploy; is adaptable to a variety of different locations and situations; and which is safe and easy to use is wanted for construction, inspection and maintenance.

PRIOR ART

U.S. Pat. No. 4,154,318 and French Patent 2845715 disclose the use of a mobile suspended scaffold which is mounted onto a vehicle. The vehicle is driven along a bridge enabling work or inspection. If there are obstacles along the edge of the bridge the whole scaffold must be retracted and repositioned making it awkward to use in some circumstances. Some existing scaffolding systems are a suspended type ones (PERI type), but they have supporting and stabilizing elements as beams, frames or portal frames mounted on the upper surface of the structure/bridge resulting in blocking or restricting of this space use for other purposes whilst the scaffolding is present.

An object of the invention is to overcome problems associated with aforementioned construction, inspection and maintenance systems by providing a single system that is suitable for a variety of different structures, which is physically able to be re-arranged to suit different applications and that is simple and cheap to use and is readily deployed and most importantly safe. No prior art arrangements achieve simple and effective stabilization of the suspended object in relation to the solid structure by the method described in this invention.

SUMMARY OF THE INVENTION

According to the present invention there is provided a suspended scaffolding system which includes a connector system adapted to engage a fixture, the fixture in use is in contact with a surface of a structure, an arm connects the suspended scaffolding system to the connector system, so that in use the suspended scaffolding system is suspended below the structure, characterised in that, the connector system has connectors that permit relative movement with respect to the fixture in two orthogonal planes.

Preferably, relative movement is permitted with respect to the fixture in three orthogonal planes.

Thus, according to this aspect of the invention, the scaffolding system is able to move laterally (from side to side). This lateral motion is achieved by way of the connector. Preferably, the connector comprises a spherical device supported within a tubular device, but other solutions, for example as Cardan mount, can be used. In a preferred embodiment, the connector includes a spherical bearing. The connector may comprise a universal connector.

Alternatively, the connector includes a ball and socket device.

It is preferred that the fixture comprises a track along which the scaffolding system can run. This enables the scaffolding system to move both laterally (from side to side) and forwards and backwards.

Rapid, safe and easy motion of the scaffolding system, lengthwise along the bridge or structure, is important as the quicker and easier it is able to transport equipment and personnel to a desired location the better this is. However, when reaching a specific position, it is important that the suspended scaffolding system is able to be placed into a relatively stable and stationary state so that crew using it can work on the structure safely and without undue movement in the suspended scaffolding system. Prior art generally requires elaborate locking and the deployment of safety equipment so that this could occur. Deployment and retrieval of the locking and safety equipment took time and so reduced productivity.

According to a second aspect of the invention there is provided a suspended scaffolding system including a connector system adapted to engage a fixture, the fixture in use is in contact with a surface of a structure, an arm connects the suspended scaffolding system to the connector system so that in use the suspended scaffolding system is suspended below the structure, characterised in that at least one moveable counterweight is provided on the suspended scaffolding system, which is adapted to be displaced from a first position to a second position so as to change the centre of gravity of the suspended scaffolding system.

The invention provides an alternate manner of providing movable scaffolding for a structure by utilising a counterweight to stabilize a suspended movable scaffolding, having adaptable geometry, easily stabilized, lockable and equally easily releasable during the process of work carried out, able to overcome obstacles structurally present in the main structure without using large areas of the upper surface of the structure for mounting support elements.

The scaffolding is suspended from a fixture which preferably comprises a rail, either on the top of the main structure, its edge or underside. If the rail and a cooperating carriage system on the scaffolding system is used as the attachment, the working platform and the scaffolding can move as work progresses along the structure.

A further object of the invention is to provide a suspended scaffolding system having a support positioned on one or more of the upper, side and/or lower surface of a structure whereby a counterweight movable between two positions moves the suspended scaffolding system's centre of gravity thereby producing a pushing force for stabilizing the equipment in a working position against main firm structure or object (building, bridge, slab, terrace or cliff, rock, cave, ship etc.).

Thus the movement of the counterweight changes the position of the centre of gravity of the system by producing an acting force that pushes the suspended scaffolding against the main stable structure and in that way stabilizes scaffolding position.

Preferably, a hydraulic jack powered by a motor is provided to displace the counterweight. Alternatively or additionally a hand crank is provided to displace the counterweight. Another system of displacing the counterweight can be introduced, electric or pneumatic jack for example, or even manually operated one such as a chain winch or pulley. The person skilled in the art will appreciate which alternative embodiments are suitable for use with the system.

According to a third aspect of the invention there is provided a suspended scaffolding system which includes a track connector system adapted to engage a track, the track in use is in contact with the surface of a structure, characterised in that the track connector system comprises at least three fasteners each of which is in contact with the track and each is adapted to be temporarily removed from the track, when encountering an obstacle, so as to permit the suspended scaffolding system to negotiate the obstacle or to move into a new position.

According to a fourth aspect is a method of moving a scaffolding system which is movable along a rail, the rail being fixed to a surface by at least one fastener comprising the steps of:

providing a further fastener to fix the rail to a structure;

removing one of the at least one fasteners to enable the scaffolding system to progress its' movement; and optionally replacing the removed fastener once the scaffolding system has progressed its' movement.

The fastener can be removed from the rail entirely or pivoted out of the way. This arrangement enables the scaffolding system to be used along the entire length of a structure, straight or curved, which is for example a bridge, on a rail, runner or section of a rail or runner. Sections of rail or runner may be removed and placed ahead of another section.

In a preferred embodiment, the suspended scaffolding system includes a suspended working platform (SWP™) and a safety rails disposed around a periphery of the working platform.

Traditionally, in this type of system, reaction bearings or end stops are used to prevent the scaffolding system overrunning and either becoming completely dislodged from the rail or causing damage to the connector of the scaffolding system. However, the fact that end stops are used means that these have to be removed when a new rail section is added which is time consuming and requires extra parts.

In the present invention, it is preferred that a rail end automated blocking device, designed within the rail itself, is used which are active if the rail segment is the end one, but which is de-activated by the connection on the next rail segment. This has the added safety advantage that a worker does not have to remember to add an end piece during construction; each rail has an end piece integral to it.

According to another aspect of the invention, there is provided a method of stabilizing a suspended structure comprising the steps of: providing a suspended structure; and adjusting the suspended structures' centre of gravity away from a neutral position thereby producing a stabilizing force.

Preferably, the adjustment of the suspended structures' centre of gravity is achieved by one or more of counterweight movement, ballasting and swinging. Example include moving a mass element (sliding, swinging, rotating, pumping ballast from tank to tank) or by adding or removing mass to/from the object (filling/emptying ballasting tanks).

In a preferred embodiment, the stabilizing force is transferred to a supporting structure using a bumper.

Preferably, there is provided one fixed suspension point located on the upper, side or lower edge/surface of the structure and at least two bumpers of the suspended object in contact with the structure, giving in total three points of stabilization of the suspended object position.

In a preferred embodiment, there are provided two fixed suspension points located on the upper, side or lower edge/surface of the structure and at least one bumper of the suspended object in contact with the structure, giving in total at least three points of stabilization of the suspended object position.

Adjusting the centre of gravity by deployment of for example a counterweight, the centre of gravity of the scaffolding system is shifted from a first location, at which the scaffolding system hangs freely on one or more fixing points and is able to move freely, for example by running along a rail, to a second location in which the scaffolding system is urged against the structure so that the scaffolding system is held in a relatively fixed position with at least two points in contact with a rail or runner and at least one, the third point in contact with the structure, which as a result of a reaction force ensure that the scaffolding system remains stationary, but which can be moved to a different location relatively quickly and easily, even by personnel who are on board a working platform supported by the scaffolding.

Preferably the third point of contact is by way of a friction pad or buffer/bumper.

Preferably, the suspended scaffolding system comprises a contact point, with the structure, includes a reaction bearing roller.

Therefore, it is an object of the invention to provide the technical stabilization method of the suspending objects/technical equipment in relation to the main stable outer structure by using the adjustable and lockable counterweight as part of the suspended object and by this counterweight intentional displacement inducting pushing/locking force stabilizing the suspended object to the main structure.

When using movable and adjustable counterweight and bumper/buffer system the SSS—Suspended Scaffolding System do not requires any additional top surface level or under surface level cooperation or support except own one. When the movable and adjustable counterweight is engaged it pushes the SWP—Suspended Working Platform towards the bridge/structure locking it into position. When the counterweight is disengaged, there is no pushing and no contact with the bridge/structure and the SWP can be easily moved/passed, to the new working area.

The SSS—Suspended Scaffolding System is more practical and cost-effective solution, than the currently used ones: top support mounted frames with suspended arms; trailer under bridge inspection units; lower level surface mounted up scaffolding for the structure above. The invention is presented here (as particular example, not excluding other different applications) as the mode to construct the suspended scaffolding with working platform (SWP) for carrying the maintenance or structural work from underneath the bridge/structure without using the constructing extended scaffolding structures on the top of the bridge as support for the mounted down scaffolding towers with suspended on the underside working platforms. The SSS solution saves time and money, as well leaving upper bridge/structure surface freely accessible for other stages of construction work or the standard uninterrupted and not distracted use.

The invention will now be described, by way of example, with reference to the accompanying drawings: in which:

DETAILED DESCRIPTION OF THE ILLUSTRATED EMBODIMENT

Figure 1:
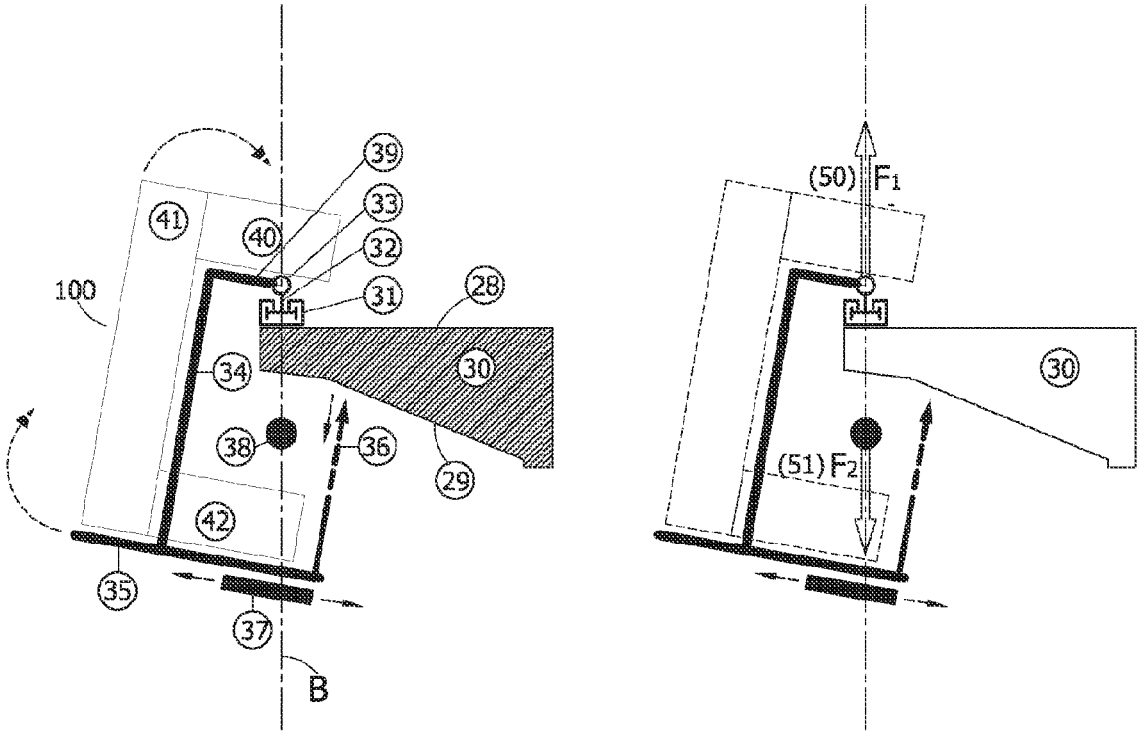
FIG. 1 is a diagram of the technical stabilizing device and main acting forces scheme showing a suspended object in free hanging and moveable position, for the option of upper surface fixing to the main structure.

FIGS. 1 to 10 illustrate some general usage scenarios of a device according to the invention providing suspended objects stabilization by pushing them to main stable structure 30 by using force from moving the suspended object's centre of gravity 38 away from its neutral position. The centre of gravity 38 movement is caused by position adjustment of counterweight 37 component of the device.

Each of FIGS. 1 to 10 show (in different configurations, mounting and usage scenarios) the same elements of the invented stabilization method: the structure 30 (building, bridge, slab, and terrace, ship . . . ) to be accessed for carrying the work from beneath 29 structure 30. There are three main parts, the attachment system 31,32,33 of the suspended object/scaffolding which is the connection to the structure 30, a suspended object/suspended working platform 34,35,36,37,39; and additional features such as scaffolding 40, 41, 42. The attachment system 31,32,33 comprises a fixture including one or more fixing points or a rail 31, temporarily or permanently fastened to the structure 30.

For applications in which the suspended object is movable along the length of the structure, a rail 31 is provided for attachment to the structure 30 and one, two or more independent carriage/truck sets 32 are provided which roll within the rail 31 connected via a pin mounted in a bearing 33 at the end of the suspended object/suspended working platform beam or arm 34,39.

The fixing system includes a spherical bearing 33 or Cardan mount or any other bearing solution allowing rotation in any plane. The suspended object/suspended working platform frame is represented here by the suspended object/suspended working platform beam or arm 39 (FIGS. 1 and 2 only), vertical mounted down arm/frame 34, and a horizontal working part of the platform 35, with adjustable (angle and length) bumpers/buffers end 36. The use of the platform 35 as a working environment would require optional add-in for example: allowing access horizontal platform 40—any scaffolding system or other, scaffolding stair tower access 41—any scaffolding system or other, lower working level horizontal platform 42 with side bars—any scaffolding or formwork system.

The whole suspended object/suspended working platform 34,35,36,37,39 in a free hanging position (FIGS. 1, 3, 5, 7, 9) is hanging freely on two or only one support points 31 vulnerable for example for the wind pressure, not stabilized, even free swinging, with the possibility of hitting the structure 30 if prevention measures are not taken against that (i.e. Dumpers can be used to reduce swinging caused by wind).

In examples where the support points 31 are provided on a rail, in this configuration—hanging freely—the suspended object is easily movable along the length of the structure and can pass obstacles.

The suspended working platform 34,35,36,37,39 comprises suspended object/suspended working platform beam or arm 39 through which the suspended object is attached to the structure 30, vertical side frames 34, a horizontal frame of working platform 35 and bumpers/buffers 36 for abutment to the underside 29 of the structure 30. The angle and length of the bumpers and buffers 36 are adjustable according to need. In the free hanging position (FIGS. 1, 3, 5, 7, 9) there is no contact of bumpers/buffers 36 with the main structure 30.

The stabilization effect of the free hanging object to the main outer structure is achieved by adding a counterweight 37, to the suspended object/scaffolding, and adjusting this counterweight's position. The counterweight can be moved and locked in different positions in relation to the suspended object/scaffolding, for example by the use of rails and hydraulic jack).

When the centre of gravity 38 of the whole hanging structure (suspended working platform 34,35,36,39 and counterweight 37 and possibly workers, equipment and materials as well as add-on accessories) is in a neutral position, it lies within a strictly vertical plane B below the upper attachment point/points 31, then the whole structure is hanging freely—like the scheme pictured on FIGS. 1, 3, 5, 7 and 9.

When the counterweight part 37 of the whole suspended working platform 34,35,36,39 is intentionally repositioned in direction C opposite the main outer structure location 30 i.e. away from the centre of the structure 30 or towards an outer edge of the structure 30, then the centre of gravity 38 of the whole structure (suspended working platform 34,35, 36,39 and counterweight 37 and possible workers, equipment and materials as well as add-on accessories) is moved off its neutral position—like the schemes pictured in FIGS. 2, 4, 6, 8 and 10.

In this position, the main acting force—the gravity, is forcing the shifted centre of gravity 38 back towards neutral position which is exactly within a strictly vertical plane below the upper attachment point/points 31. However, this movement is prevented by the bumpers/buffers, that indicated force F3 52 is then transferred into the structure 30 via bumpers/buffers 36, and the passive resistance of the structure 30 gives the stability to the whole equipment. The suspended object/suspended working platform remains then in the stabilized, locked-in, working position, as pictured in FIGS. 2, 4, 6, 8 and 10.

Note: the forces diagrams of FIGS. 1 to 10, show only main vertical forces acting 50,51,52 and 53 on the components; where F1 force 50 is a vertical component of reaction force on the main structure 30 in the place of upper supporting/fixing point/points or rail; F2 force 51 is a gravity force of the whole suspended object; F3 force 52 and/or F4 force 53 is/are present only for locked-in stabilized position (FIGS. 2, 4, 6, 8 and 10), as a vertical component or reaction force, when the suspended object/suspended working platform 34,35,36 is locked in working position by counterweight 37 displacement and passive resistance on the base structure 30 provides a brace.

In the free hanging position of the suspended object (FIGS. 1, 3, 5, 7 and 9) the F2 acting gravity force 51 is lined up with the F1 re-acting force 50 of the supporting main structure 30, and the system is in equilibrium. In the locked-in stabilized position (FIGS. 2, 4, 6, 8 and 10) the F2 acting gravity force 51 is displaced from the line of the F1 re-acting force 50 of the supporting main structure 30, and the system has a horizontal component reaction force forcing the shifted centre of gravity 38 towards it neutral position strictly under the attachment point/points 31 to the main structure 30. The other component forces (horizontal) would be: wind pressure and horizontal component force of F3 reaction 53, as the bumper 36 pushes on the angled surface of main structure 30. All horizontal forces would be transmitted onto the structure 30 via the attachment system 31,32,33 and bumpers 36.

Figure 3:
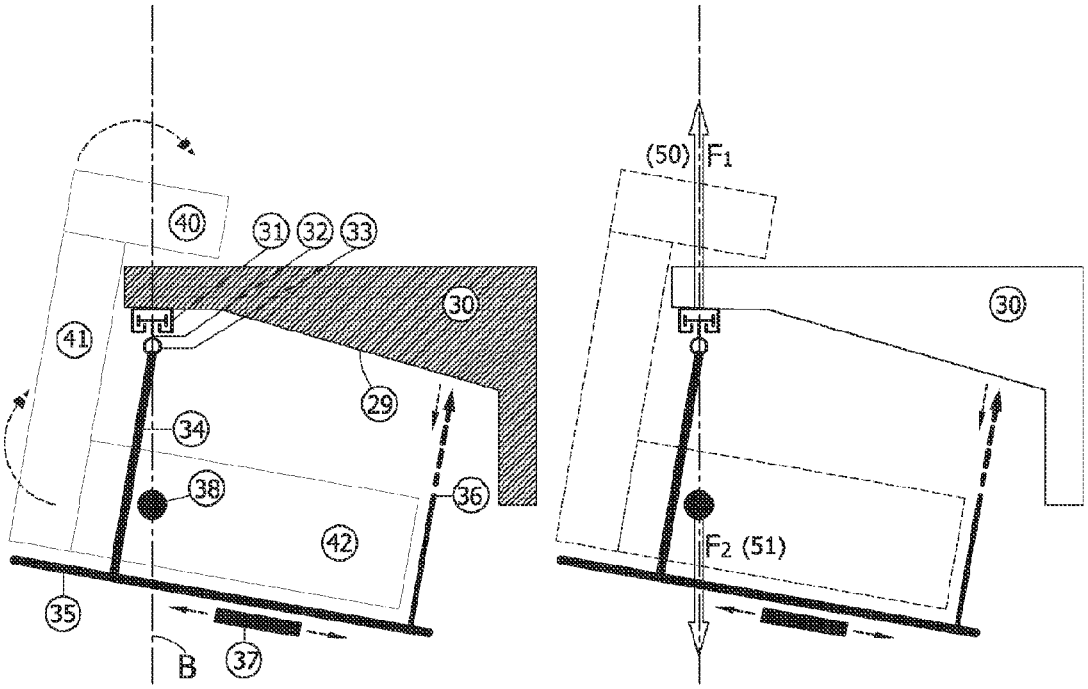
FIG. 3 is a diagram of the technical stabilizing device and main acting forces scheme showing a suspended object in free hanging and moveable position, for the option of underside surface fixing to the main structure.
Figure 5:
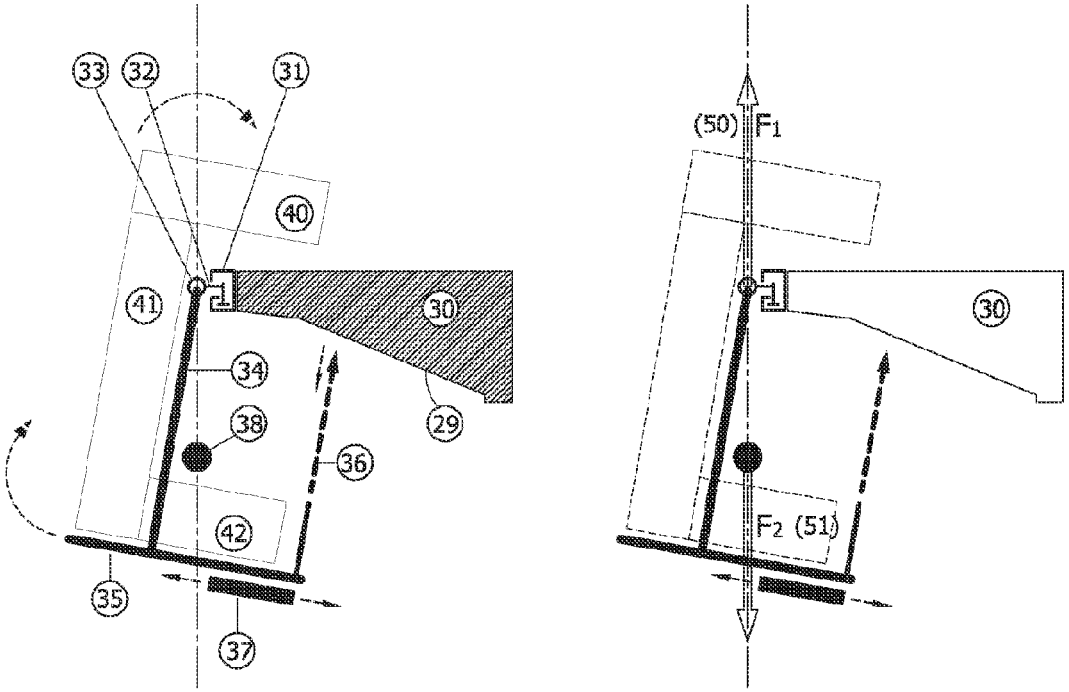
FIG. 5 is a diagram of the technical stabilizing device and main acting forces scheme showing a suspended object in free hanging and moveable position, for the option of side surface fixing to the main structure.

FIGS. 1, 3, 5 show the diagrams of the technical stabilizing device and main vertical components of acting forces 50,51 scheme showing suspended object (example: Suspended Working Platform—SWP) 34,35,36,39 in free hanging and moveable/passable position, respectively for the options of upper, underside and side surface fixing to the main structure 30. In the free hanging position of the suspended working platform 34,35,36,39 the counterweight 37 is used as a member to balance required geometry of the whole equipment (for example when in the process of moving from one to the other work location along the structure). The counterweight 37 position is to be adjusted manually or mechanically, operated from the working platform 35 or elsewhere by remote control.

Figure 2:
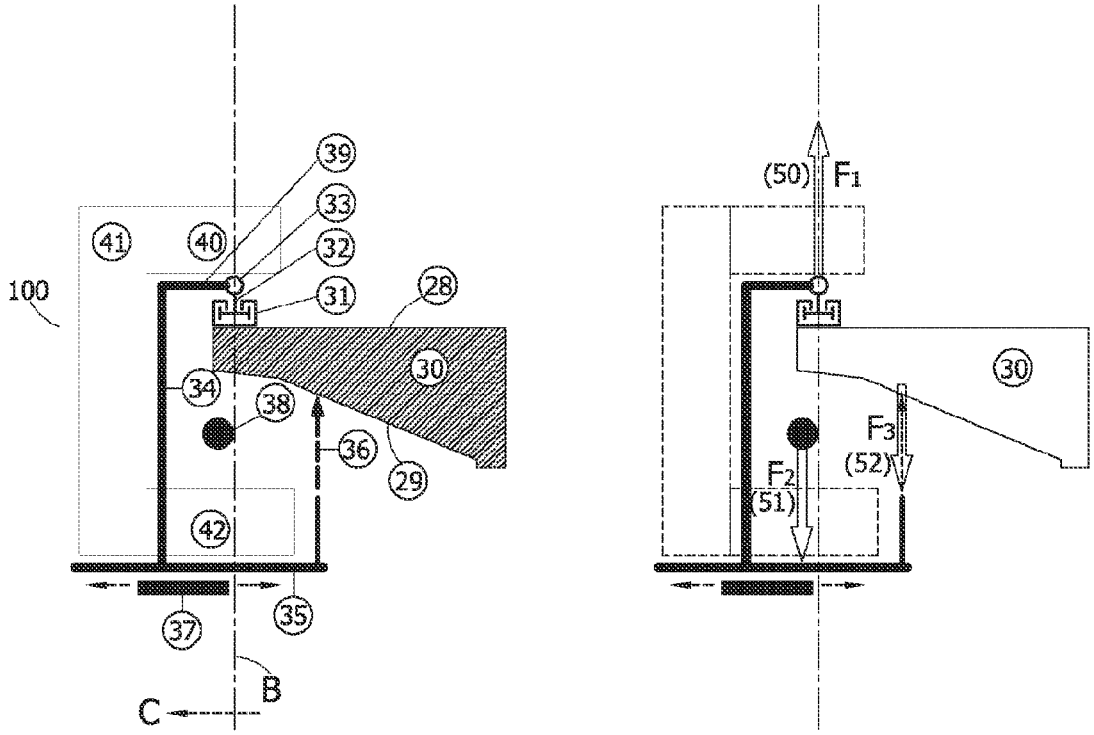
FIG. 2 is a diagram of the technical stabilizing device and main acting forces scheme showing a suspended object in working position, for the option of upper surface fixing to the main structure.
Figure 4:
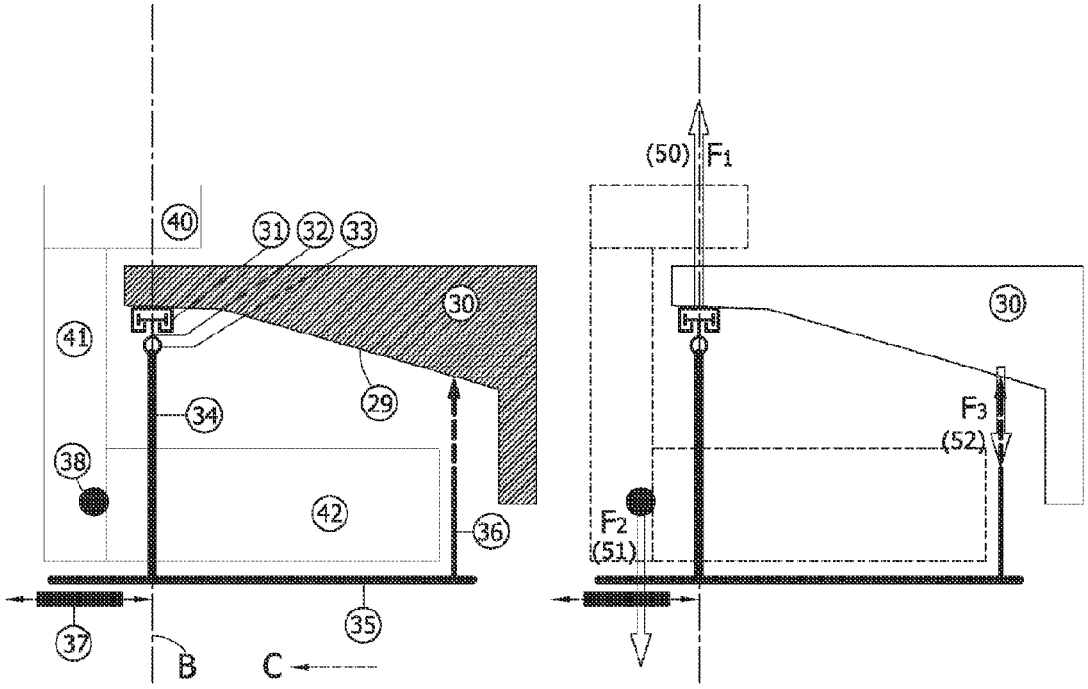
FIG. 4 is a diagram of the technical stabilizing device and main acting forces scheme showing a suspended object in working position, for the option of underside surface fixing to the main structure.
Figure 6:
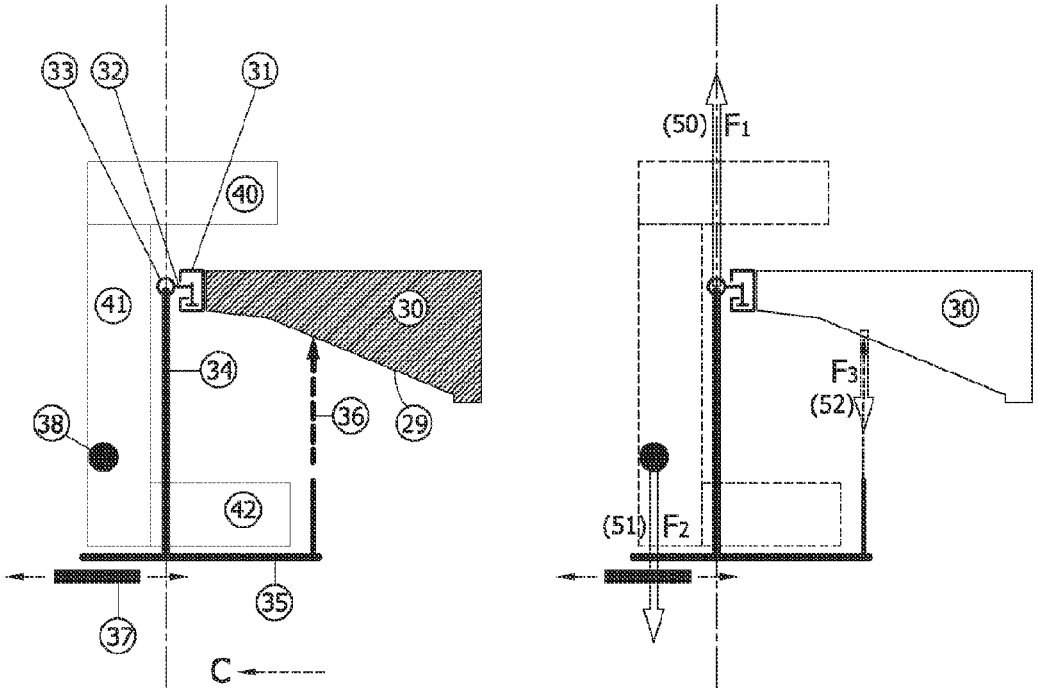
FIG. 6 is a diagram of the technical stabilizing device and main acting forces scheme showing a suspended object in working position, for the option of side surface fixing to the main structure.

FIGS. 2, 4, 6 show the diagrams of the technical stabilizing device and main vertical components of acting forces 50,51,52 scheme showing suspended object (example: Suspended Working Platform—SWP) 34,35,36,39 in stabilized, locked-in for work position, respectively for the options of upper, underside and side surface fixing to the main structure. In the locked-in, secured and stabilized working position of suspended working platform 34,35,36,39 the counterweight 37 is acting as a member generating the pushing/locking force, bracing the suspended object 34,35,36,39 to the main structure 30. The repositioned and lockable counterweight 37 shifts the centre of gravity off its neutral position and acts here as the member generating the pushing/locking force on one or two bumpers ends 36 from the re-action of the structure 30, providing the required safe and stable working environment.

Figure 7:
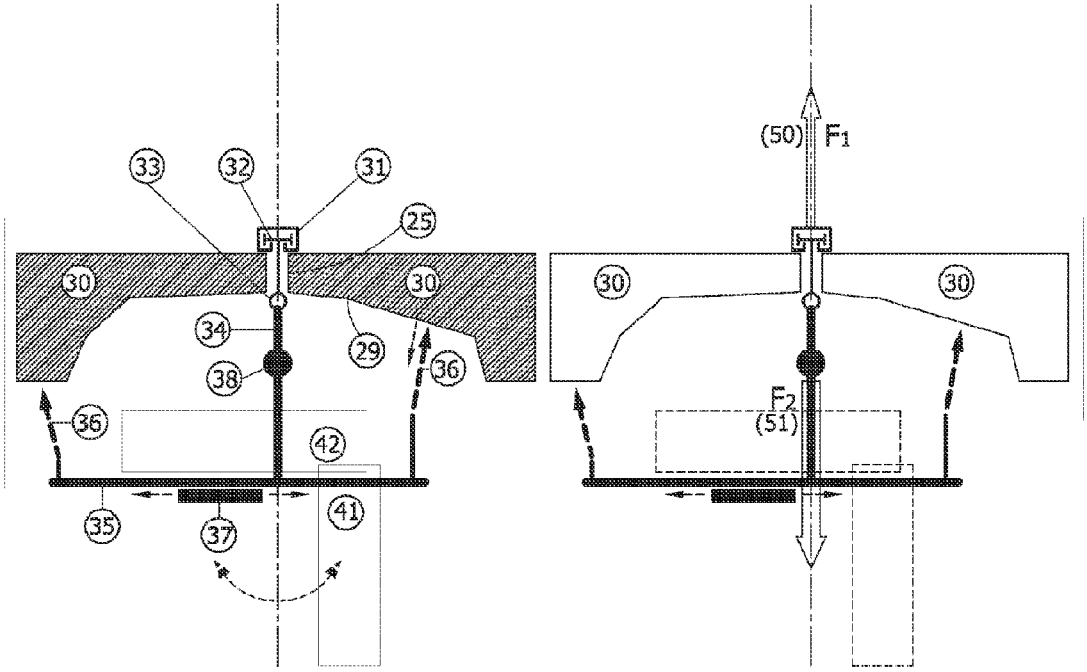
FIG. 7 is a diagram of the technical stabilizing device and main acting forces scheme showing a suspended object in free hanging and moveable position, for the option of slot upper surface fixing to the main structure.
Figure 8:
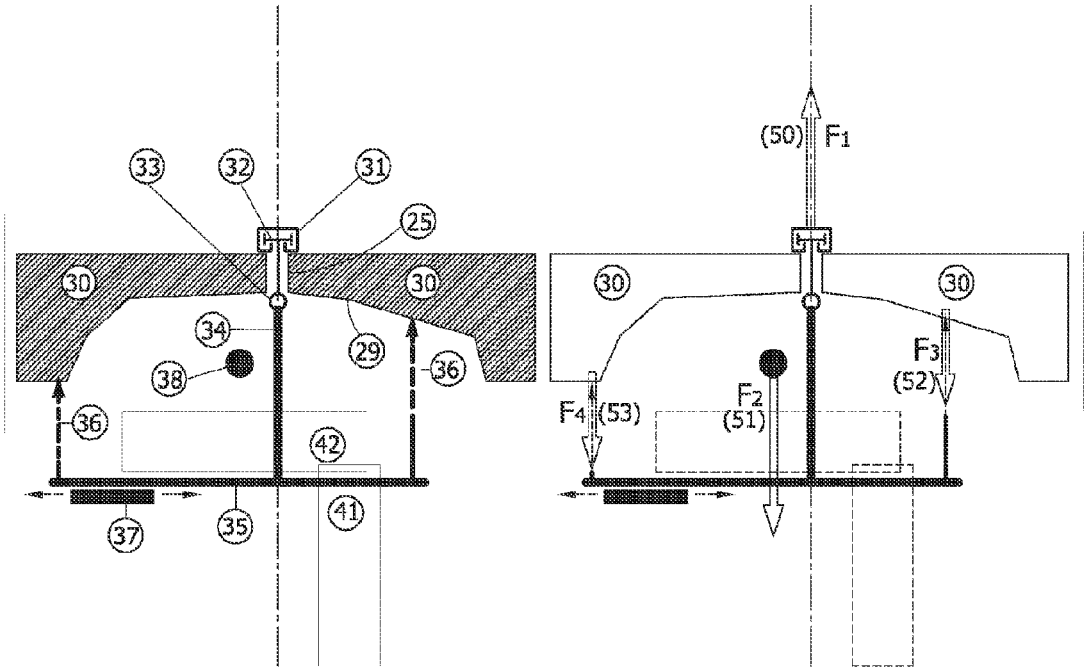
FIG. 8 is a diagram of the technical stabilizing device and main acting forces scheme showing a suspended object in working position, for the option of slot upper surface fixing to the main structure.

FIGS. 7, 8 show the diagrams of the technical stabilizing device and main vertical components of acting forces 50,51, 52,53 scheme; showing suspended object (example: Suspended Working Platform—SWP) 34,35,36 respectively in free hanging, moveable/passable position (FIG. 7) and working position (FIG. 8) for the option of in-slot, upper surface fixing to the main structure 30, when the suspended working platform 34,35,36 is beneath the twin/mirrored main structures 30 or beneath the main structure 30 with a slot, and the suspended working platform 34,35,36 is cantilevered, serving both sides underneath the structures 30; The counterweight 37 is acting here as a balance stabilizer for the total weight of workers, the suspended working platform, materials and equipment, and (using counterweight 37 adjustable position) as the member generating the pushing/locking force on one of two bumpers ends 36 from the re-action of the structure 30, providing the required safe and stable working environment.

Figure 9:
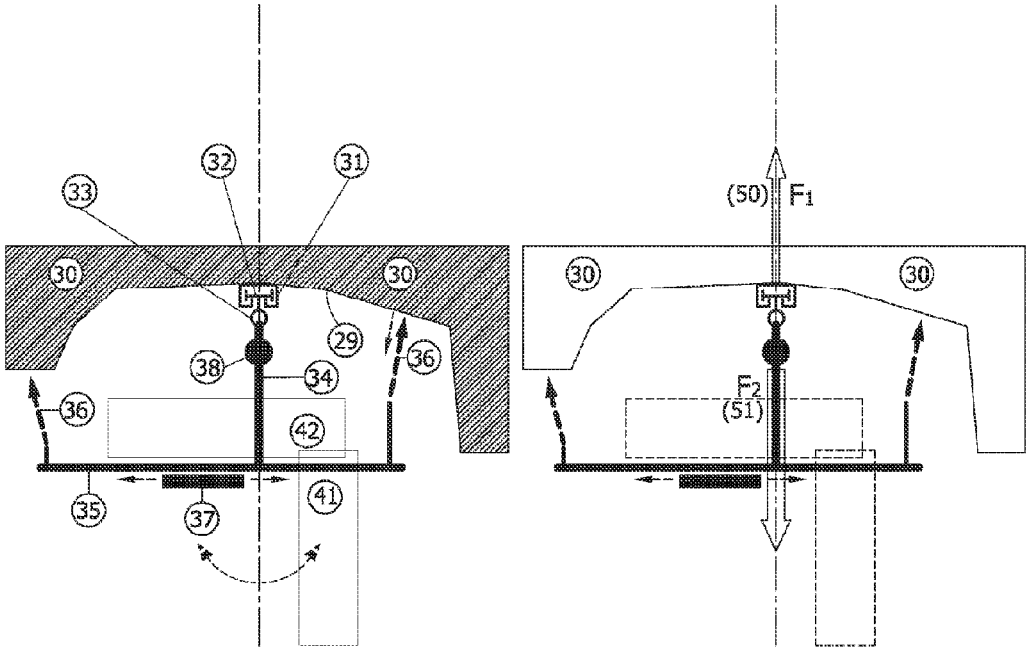
FIG. 9 is a diagram of the technical stabilizing device and main acting forces scheme showing a suspended object in free hanging and moveable position, for the option of underside internal surface fixing to the main structure.
Figure 10:
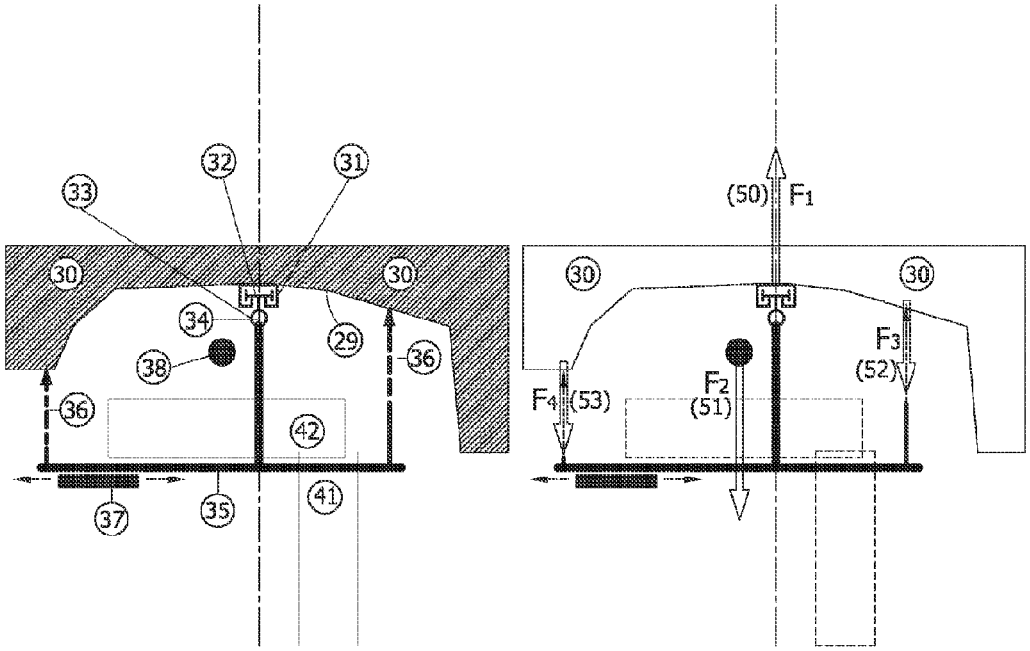
FIG. 10 is a diagram of the technical stabilizing device and main acting forces scheme showing suspended object in working position—stabilized according to the invention, for the option of underside internal surface fixing to the main structure.

FIGS. 9, 10 show the diagrams of the technical stabilizing device and main vertical components of acting forces 50,51, 52,53 scheme; showing suspended object (example: Suspended Working Platform—SWP) 34,35,36 respectively in free hanging, moveable/passable position (FIG. 9) and working position (FIG. 10) for the option of internal underside surface fixing to the main structure 30 (for example bridge of this specific geometry cross section, or cave), when the suspended working platform 34,35,36 is beneath the main structure 30, and the suspended working platform 34,35,36 is cantilevered, serving both sides underneath the structure 30; The counterweight 37 is acting here as a balance stabilizer for the total weight of workers, the suspended working platform, materials and equipment, and (using counterweight 37 adjustable position) as the member generating the pushing/locking force on one of two bumpers ends 36 from the re-action of the structure 30, providing the required safe and stable working environment. When the working platform is in the free hanging position (not stabilized, locked-in) the counterweight should be placed in such equilibrium position that neither of bumper ends 36 should be in contact with the structure.

FIGS. 11 to 20 show various aspects of an embodiment of this invention: the SWP™—Suspended Working Platform forming part of the SSS™—Suspended Scaffolding System.

Figure 11:
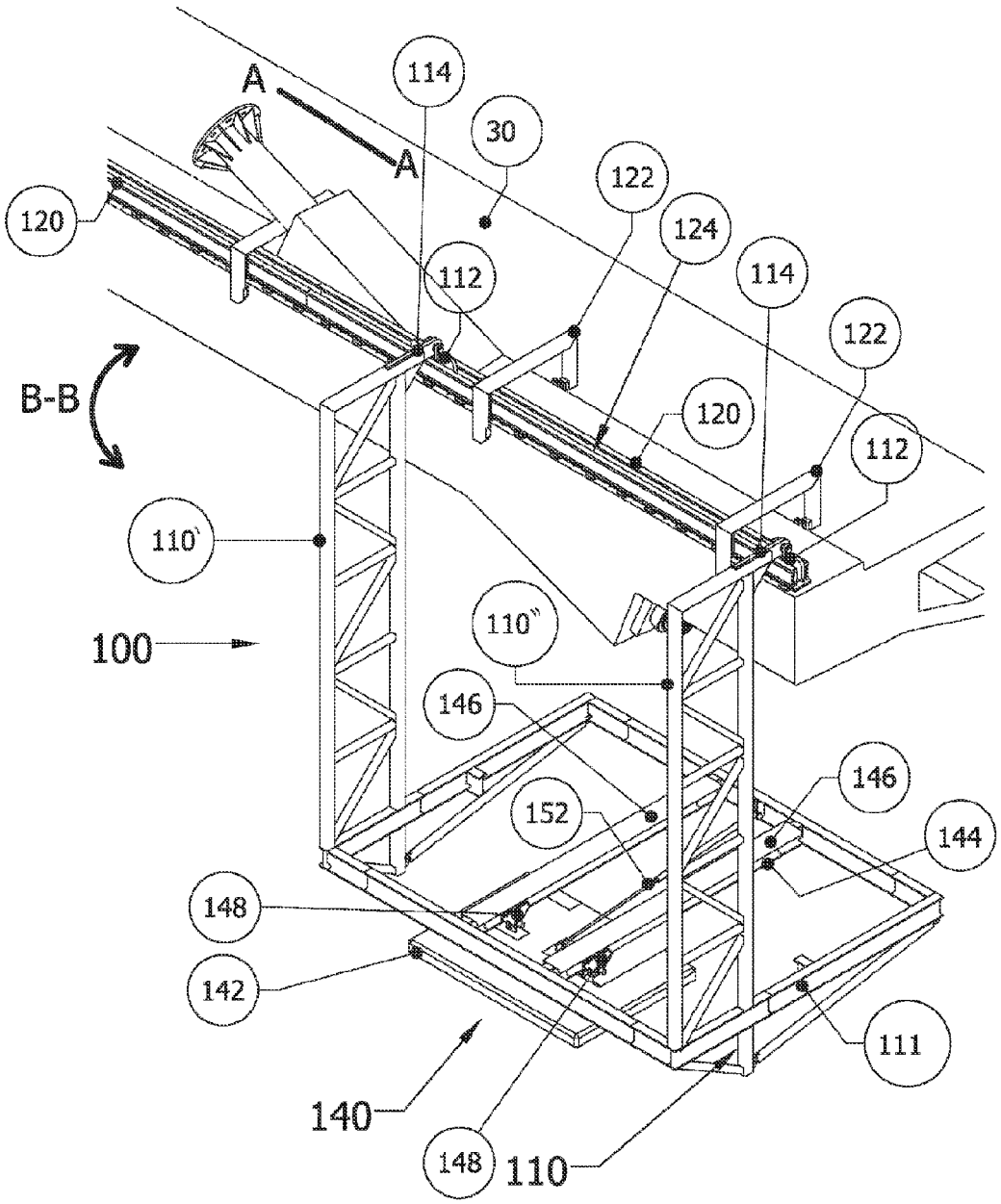
FIG. 11 is a perspective of a frame (SWP—Suspended Working Platform) for a suspended scaffolding system according to the invention.

FIG. 11 shows a frame 110,111 for a suspended working platform 100 of suspended scaffolding system and a rail or track 120 onto which the frame 110,111 is mounted.

The rail 120 is secured to a structure 30, such as a bridge, using spaced apart distance supporting pads 126 (see FIG. 18) underneath the rail 120 and rail fasteners/clamps 122 which can bridge over the rail 120 if needed. The rail 120 has a guideway 124 running longitudinally along its' length into which a carriage/truck 112 is located. The carriage/truck 112 has wheels which are adapted to run along the rail 120, within the guideway 124. The carriage/truck 112 is connected to a pivotable arm 114 of the frame 110,111 and is moveable along the rail 120 until it intersects with a fastener 122. The rail 120 is positioned such that the guideway 124 is substantially aligned with the span of the structure 30 i.e. along the longitudinal axis A-A of the structure.

The suspended working platform—SWP 100 includes frame having a base portion 111 and two side portions 110 which are disposed on opposite sides 110',110" of the base portion 111. At the distal end of each of the side portions 110 a pivotable arm 114 is provided. The frame base 111 is, in use, partially suspended beneath a structure 30 via the frame sides 110 and the pivotable arms 114.

Figure 19:
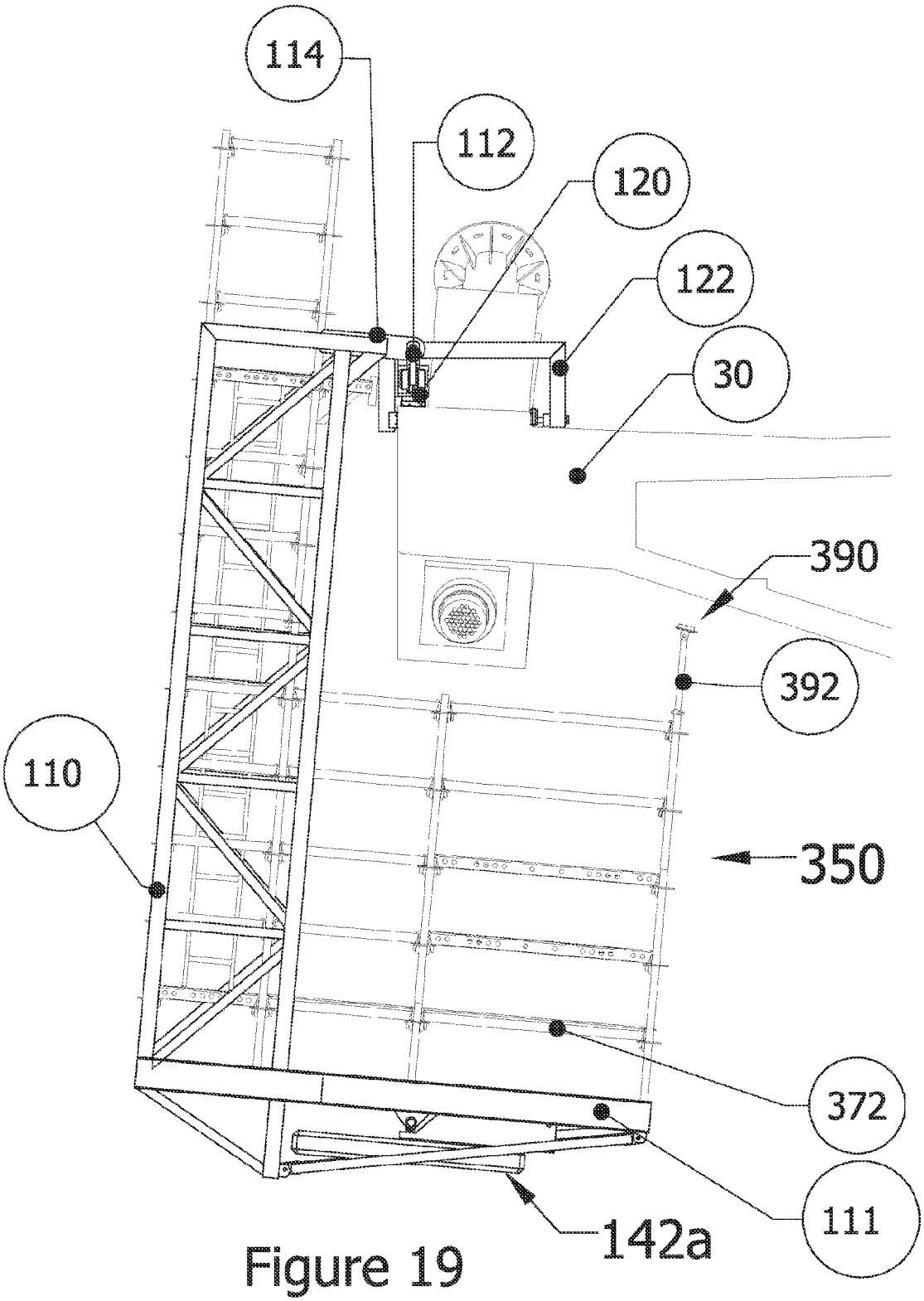
FIG. 19 is a transverse view of a suspended scaffolding system in free hanging position.
Figure 20:
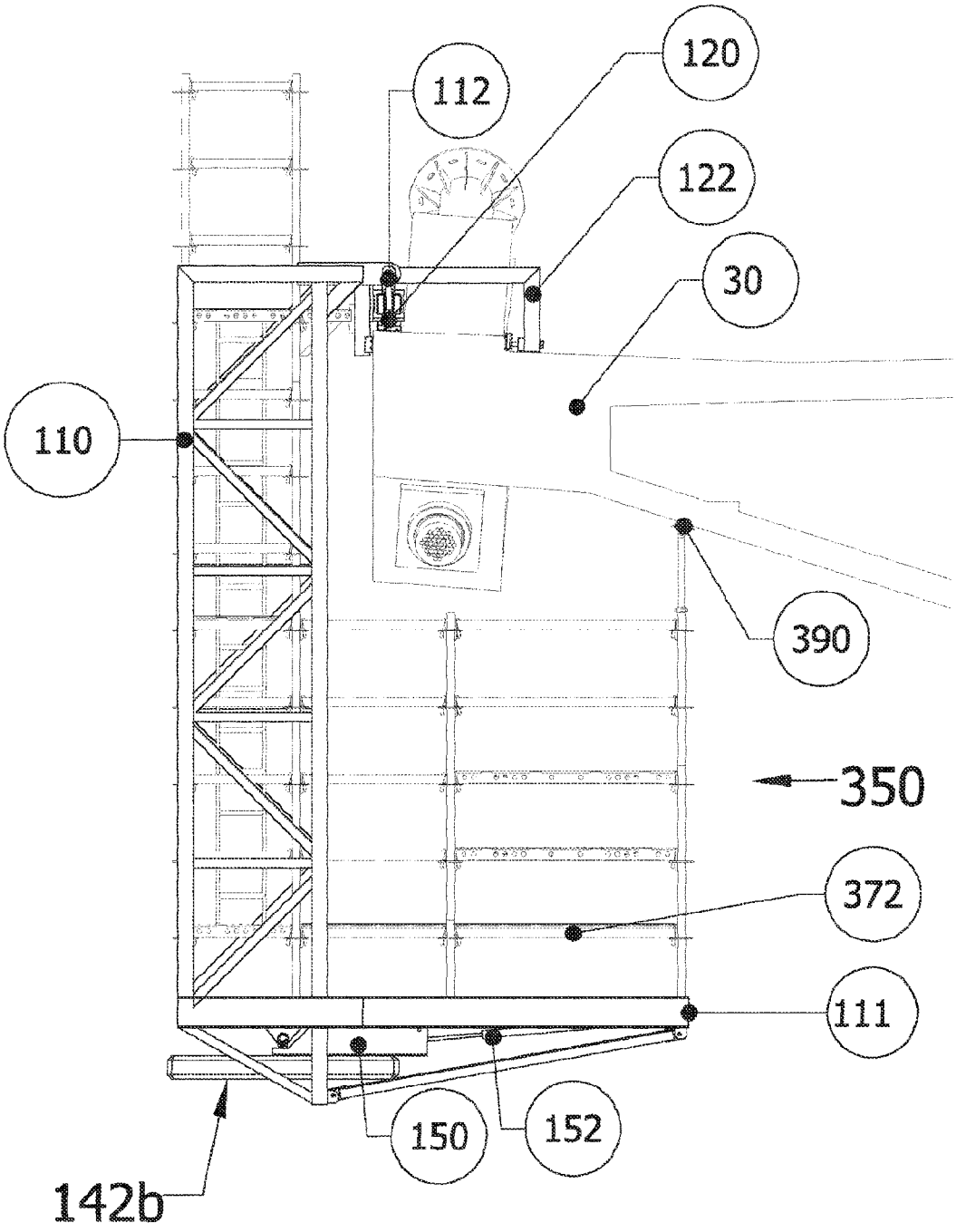
FIG. 20 is a transverse view of a suspended scaffolding system in fixed or working position.

The base 111 includes a counterweight system 140 which comprises a counterweight 142 which is moveable between working positions as shown and a non-working or passable position (see FIGS. 19 and 20 for more information). The counterweight 142 moves along a pair of counterweight rails 144 using a counterweight carriage 148. The movement of the counterweight 142 is facilitated in this example using a hydraulic jack 152 powered by a motor (not shown).

Figure 12:
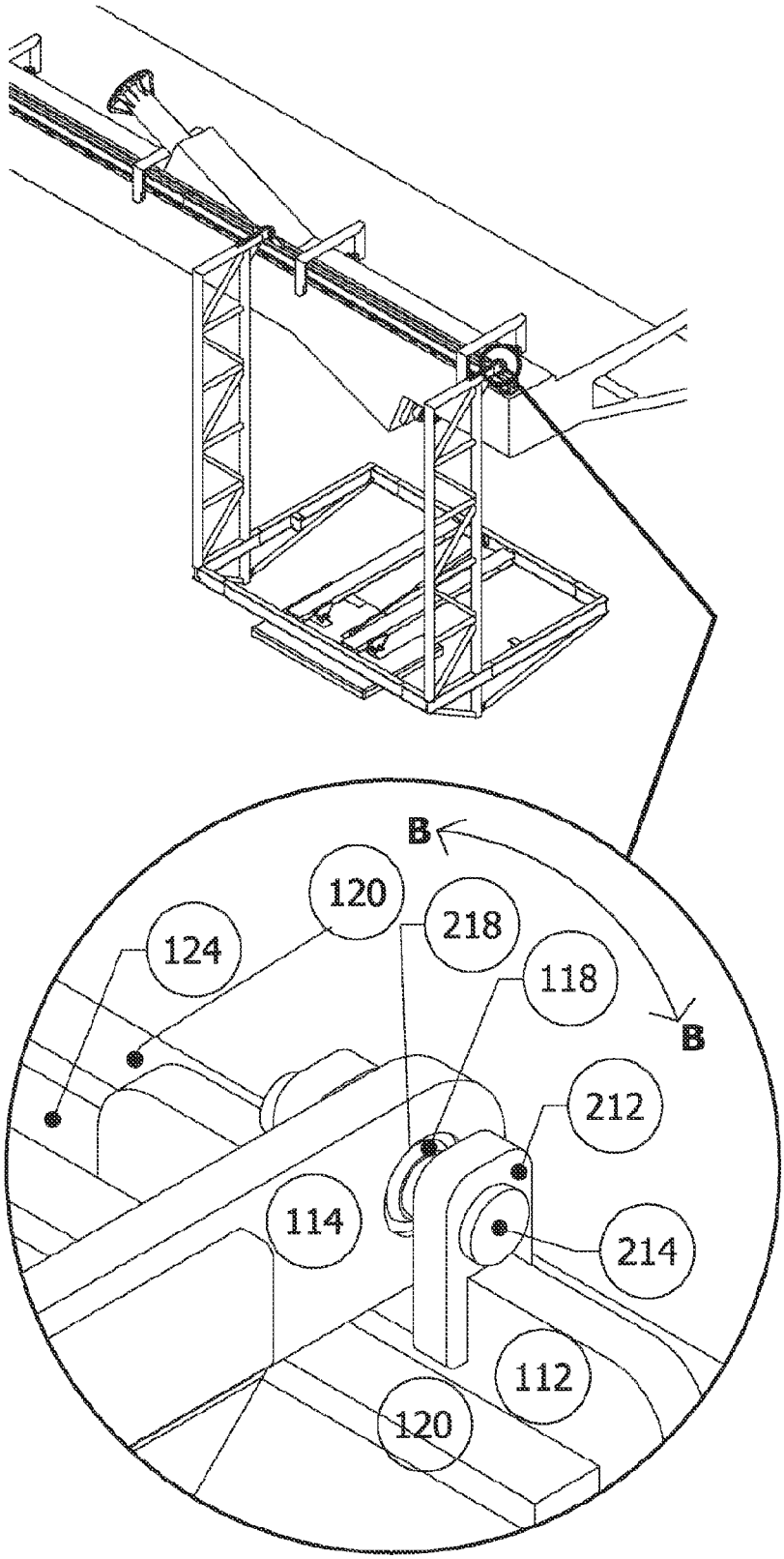
FIG. 12 is a perspective of an attachment system for attaching a frame (SWP™—Suspended Working Platform) to a rail.

FIG. 12 is a perspective of an attachment system for attaching a pivotable arm 114 of the SWP—Suspended Working Platform frame 110,111 to a rail 120.

The pivotable arm 114 includes an aperture 218 in which a spherical bearing 118 is housed. The carriage/truck 112 has two vertically disposed extensions 212 in between which the pivotable arm 114 is located. The extensions 212 each have an aperture (not shown) which align with each other and the aperture 218 of the pivotable arm 114 enabling a pin 214 or other fastener to secure the pivotable arm 114 to the carriage/truck 112 via the spherical bearing 118. When the carriage/truck 112 is moved along the rail, the pivotable arm 114 and thus the frame 110, 111 is moved along the rail.

Figure 13:
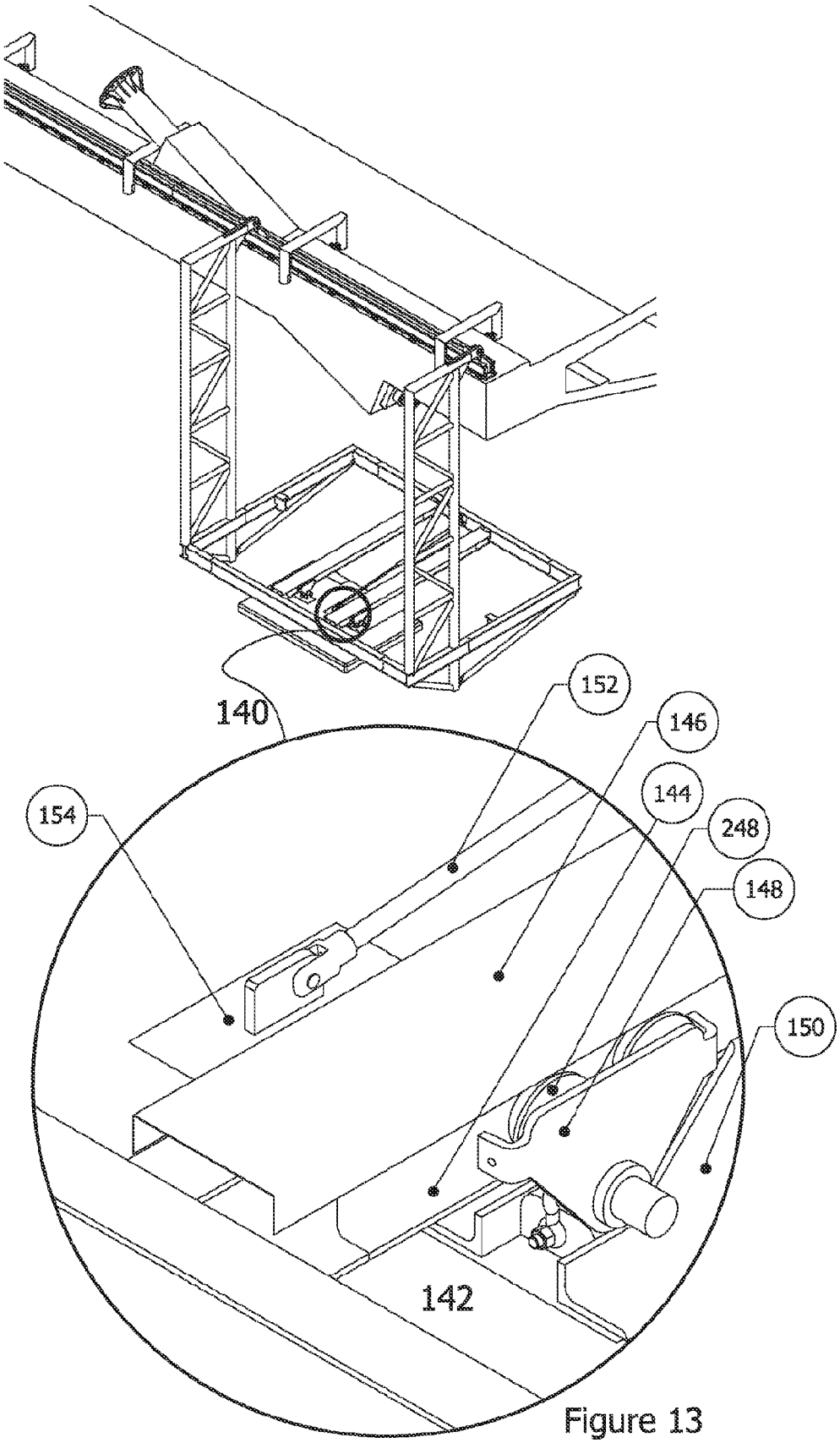
FIG. 13 is a perspective of a counterweight system according to the invention.

FIG. 13 is a perspective of a counterweight stabilizing device 140 according to the invention. A pair of counterweight rails 144 is disposed between the side portions of the frame 111 substantially parallel to the sides 110',110" (see FIG. 11) of the base of the frame 111.

The counterweight 142 is attached to counterweight carriage 148. The counterweight carriage 148 has wheels 248 which are adapted to run along the counterweight rail 144. A counterweight stabilizer 150 is introduced to stabilize counterweight from swinging. A counterweight shield 146 covers the counterweight rail 144 and the wheels 248 of the counterweight carriage 148 protecting them from damage and ingress of dirt etc. . . .

A hydraulic jack 152 is connected to either the counterweight 142, via mounted plate 154, or to the counterweight stabilizer 150 and when actuated, the jack 152 moves the counterweight 142 linearly along the path of the counterweight rails 144. Movement of the counterweight 142 is generally perpendicular to the longitudinal axis A-A of the structure 30 and this movement causes pivoting of the frame 110, 111 with respect to the structure 30 about rotational axis B-B between a free hanging and a working position when the frame 110,111 is stabilized to the structure 30.

Figures 14, 15:
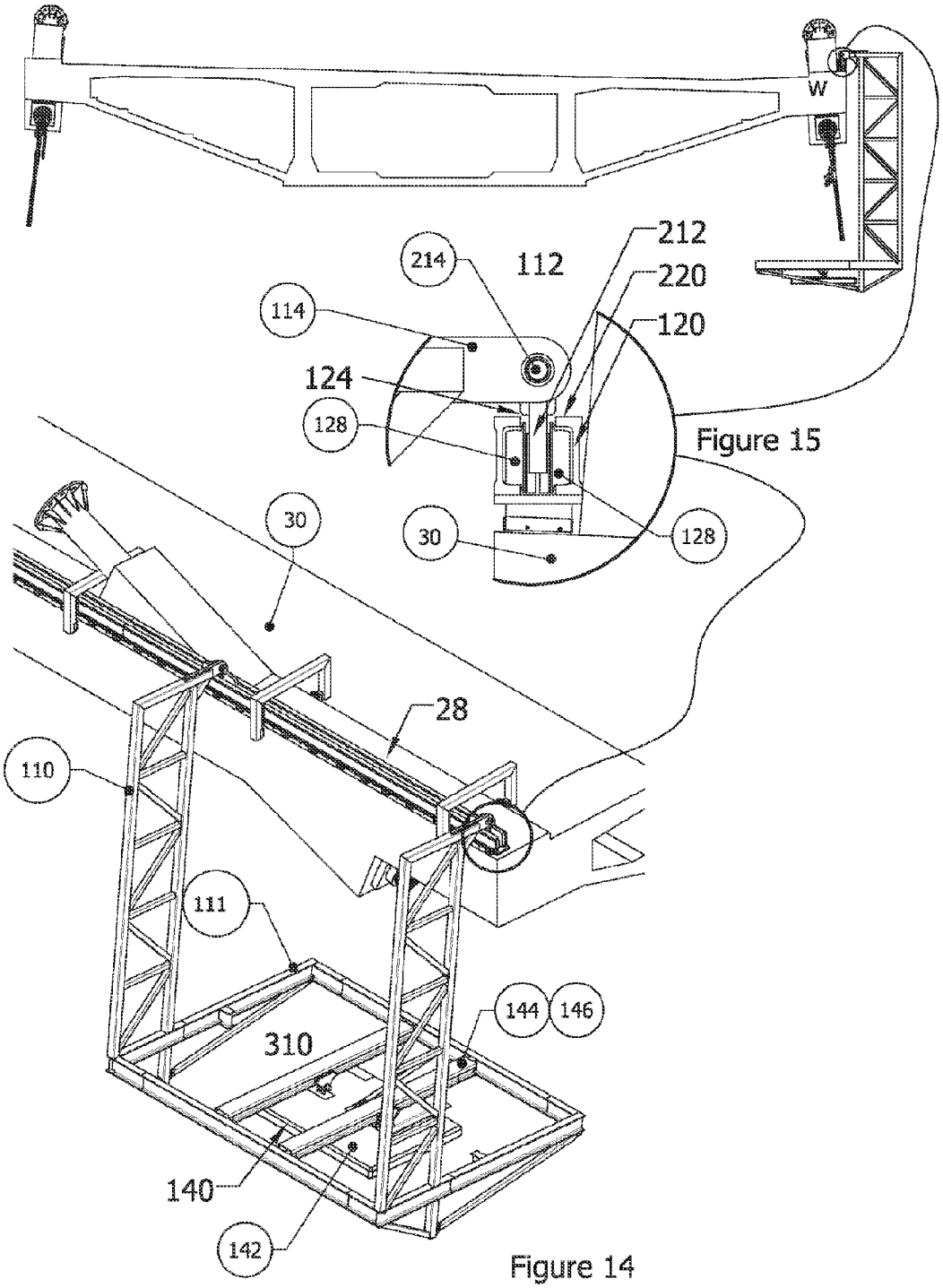
FIG. 14 is a perspective of a counterweight system in free hanging position.
FIG. 15 is a cross section through a rail and carriage truck.

FIG. 14 is a perspective of a counterweight system 140 in free hanging position. The counterweight 142 is located within the internal space 310 of the frame base 111 i.e. the counterweight 142 is located underneath the frame base 111.

FIG. 15 is a cross-section through a rail 120 and carriage/truck 112. The carriage/truck 112 has pairs of wheels 128 on each side of a central portion 212. The rail 120 comprises an overhang 220 on each side which forms the rail guide 124 and the overhang 220 prevents the carriage/truck 120 from being removed from the rail 120. The carriage/truck 112 may be a lubricated to assist in the movement along the rail 120.

Figure 16:
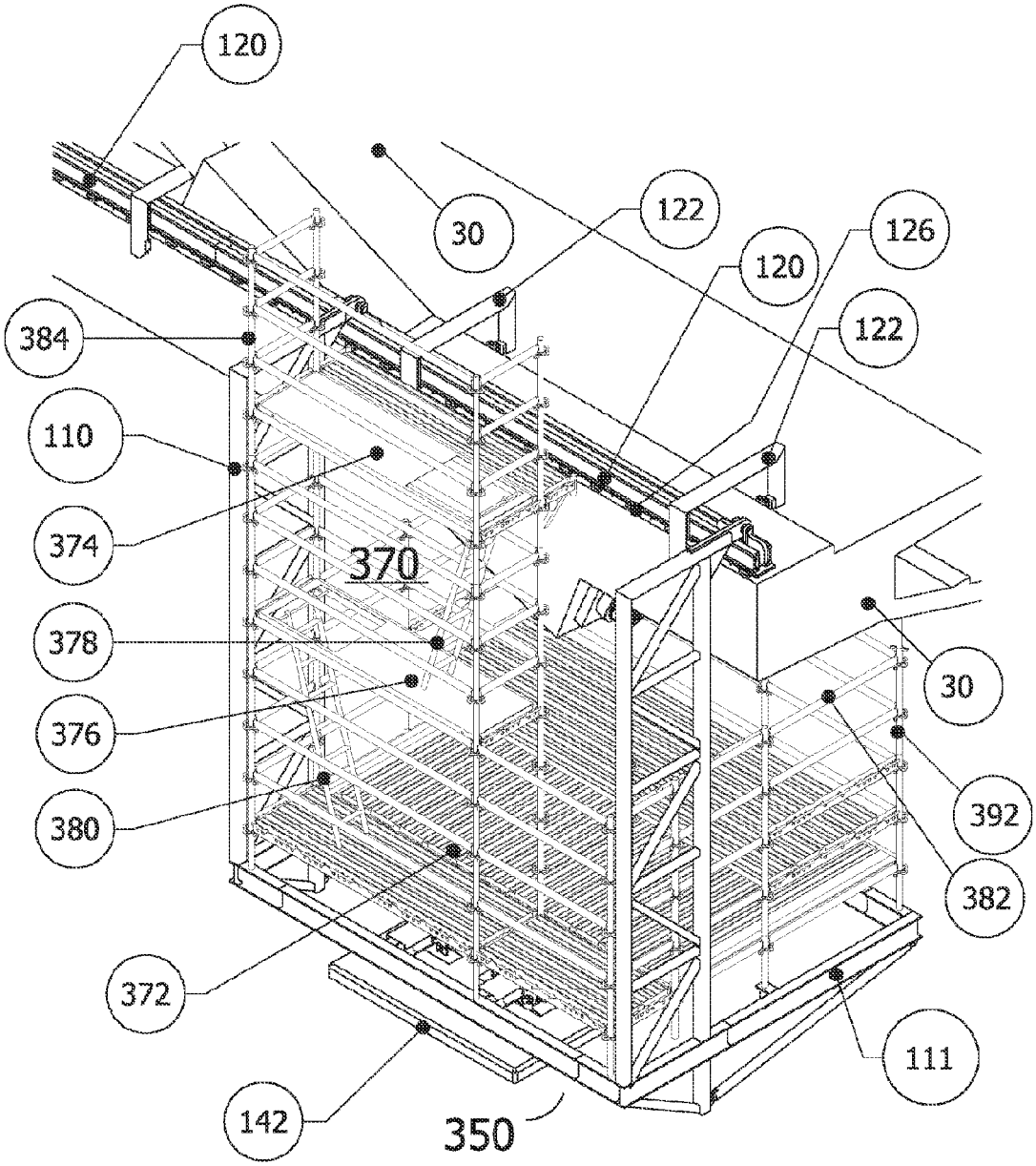
FIG. 16 is a perspective of a suspended scaffolding system according to the invention (with standard scaffolding system infill used to create safe working environment)
Figure 17:
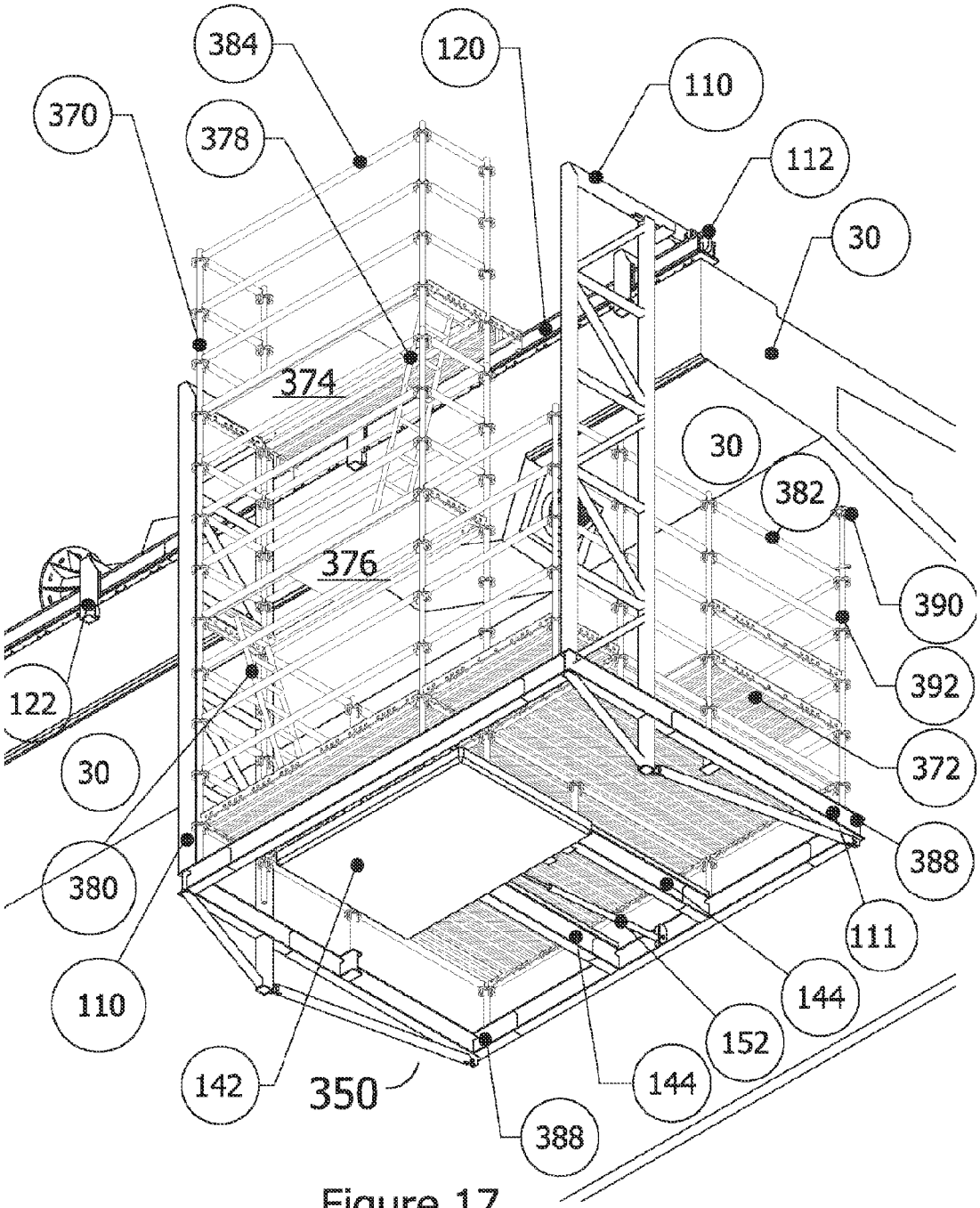
FIG. 17 is an alternate perspective view of a suspended scaffolding system.
Figure 18:
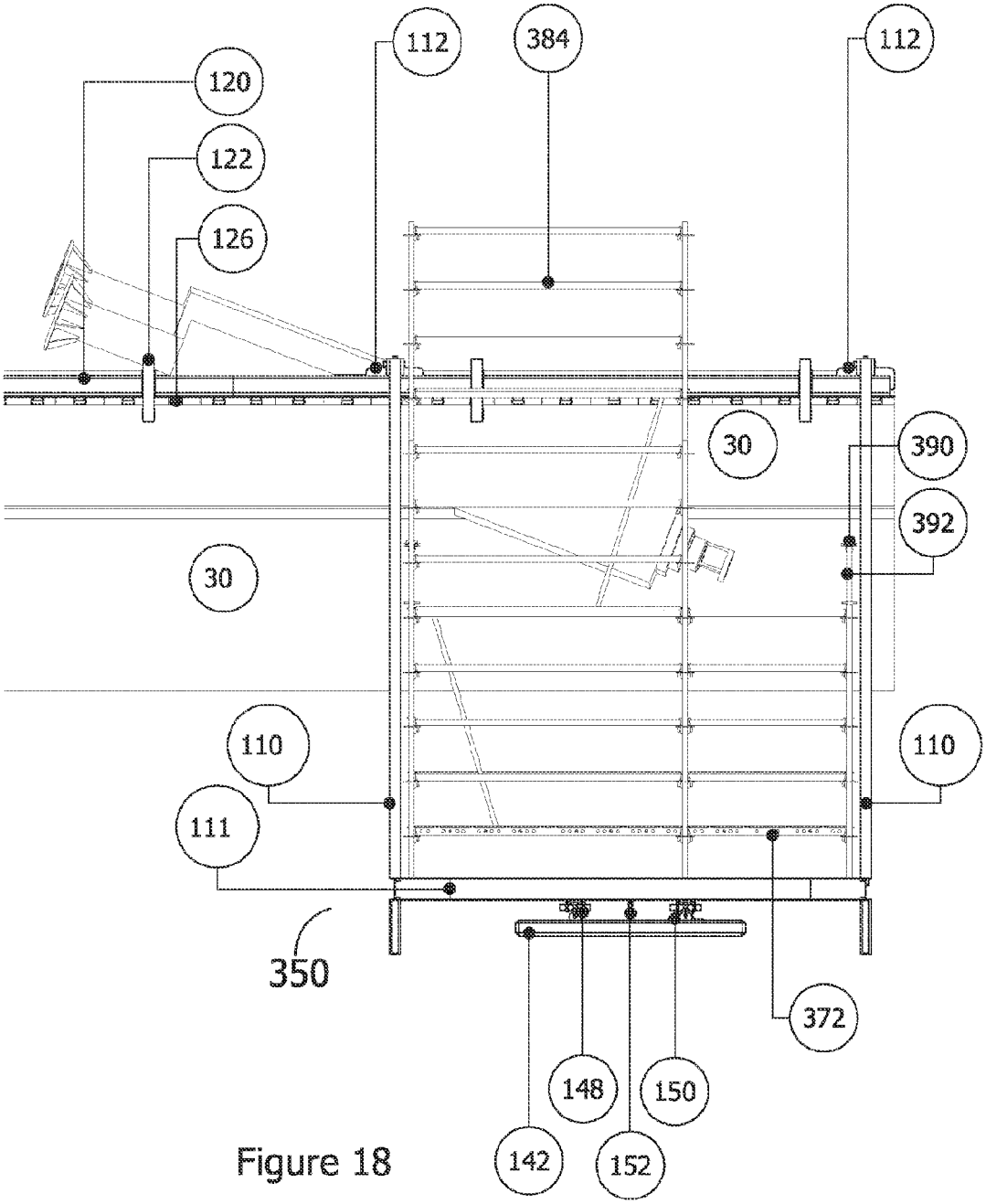
FIG. 18 is a transverse view of a suspended scaffolding system.

FIGS. 16 and 17 show different perspective views of a suspended scaffolding system 350 and FIG. 18 is a transverse view of the suspended scaffolding system 350 with standard scaffolding infill (PERI in this case). The frame 110,111 is a suspended working platform and a scaffold 370 (any standard system type infill scaffolding) is erected within the frame 110,111 providing a safe access and working environment for construction, inspection and maintenance work.

An upper platform 374 provides access from the structure 30 to a first ladder 378. In this example, an intermediate platform 376 is provided at the bottom of the first ladder 378 with access to a second ladder 380 which leads to the working platform 372. A skilled person will understand how many, if any, intermediate platforms are required.

The scaffold 370 is an infill, of suspended scaffolding system and its suspended working platform and can be any required system scaffolding for example PERI, but any appropriate scaffolding system can be used. The scaffold infill 370 creates a wall 382 around the perimeter of the frame base 111 and a tower 384 around the access point and ladders 378,380. At the corners 388 of the frame base 111 distal to the frame sides 110 i.e. the corners of the frame base 111 which are underneath the structure 30, the corner upright 392 of the scaffold wall 382 extends beyond the wall height ending in an abutment bumper or buffer 390. When the counterweight 142 is in its' working position, as shown, the abutment bumper 390 abuts the underside of the structure 30. The abutment bumper is an integrated part of this invented device, not the standard scaffolding infill.

The frame sides 110 are each connected to a carriage/truck 112 which can be moved along rail 120 which is connected to a structure 30 using spaced apart distance supporting pads 126 between the rail 120 and the structure 30 and rail fasteners 122 which bridge over the rail 120.

The rail fasteners 122 are spaced apart by a nominal distance of around 200 cm however this can be smaller or larger depending on the structure 30. The rail fasteners 122 fix the rail 120 and in addition act as a stop/obstruction for the scaffolding system 350 movements. In order to move the scaffolding system 350 further along the structure, a rail fastener 122 must be temporarily doubled (one in front of, the other behind the carriage to be moved) to allow one fastener to be removed or pivoted away from the rail 120. It is preferred that the distance and multiples of the distance between rail fasteners 122 is not the same as the distance between the two frame sides 111 so only one fastener 122 is removed or displaced at a time to allow passage of the scaffolding.

In this example, in order to move the scaffolding system 350 further along the structure, a rail support 122 must be removed or pivoted away from the rail 120. Again, it is preferred that the distance and multiples of the distance between rail fasteners 122 is not the same as the distance between the two frame sides 111 so only one fastener 122 is removed or displaced at a time to allow passage of the scaffolding.

FIGS. 19 and 20 are cross sections through a suspended scaffolding system in free hanging position and working position respectively. Referring to FIG. 19, the scaffolding system 350 is in its' free hanging or first position with the counterweight 142 located beneath the frame base 111 and the abutment bumper 390 not in contact with the underside of the structure 30. In this configuration, the scaffolding system 350 may be moved along the rail 120 enabling work, inspection or maintenance of a new section of the structure 30. FIG. 20 shows the scaffolding system 350 in a fixed or working or second position. The counterweight 142 has been displaced or moved lineally using the jack 152 towards the edge of the structure 30 and the frame sides 110 shifting the centre of gravity of the scaffolding system 350 and causing it to pivot about axis B-B (see FIG. 11) via the pivoting arms 114 and forcing the abutment bumper 390 into contact with the underside of the structure 30. In other words, the counterweight 142 is moved away from the structure 30 to produce the force that pushes the suspended scaffolding towards the main stable structure. This creates a stabilizing force or brace for the scaffolding system 350 enabling work to be carried out safely, without the working platform experiencing dangerous uncontrollable swings or movement.

Some or all of the scaffolding system 350 may be removed from a structure 30 when not in use as the scaffolding 370 is easy to dismantle and transport, the frame sides 110 could be unbolted from the frame base 111 and the rail 120 removed. Alternatively, the scaffolding system 350 is left attached to a structure 30.

The hydraulic jack may be supplemented by a hand crank in case of failure or replaced by a hand crank or alternative movement options.

In the examples shown and described herein, the rail or track 120 is shown as being located on the upper surface of the structure 30 (see FIGS. 1, 2, 7, 8) however the rail may be located on the roadway surface, on a side (see FIGS. 5, 6) or underside surface (see FIGS. 3, 4, 9, 10) of the structure; the position chosen will depend in part on the design of the structure and the manner of access to the site and the suspended working platform of suspended scaffolding system.

One use of the suspended working platform 100 is to provide under bridge access for carrying the construction, maintenance or inspection work to the lower and side surface of the structure 30. The suspended working platform 100 is delivered on the required work site in parts (dismantled or folded), then the main frame (side frames 110 and horizontal working platform 111) and other structural parts of SWP are assembled together and attached to the supporting fixing points or rail 120 (by crane for example from below, or from above; by chopper; by sea ship crane). Then the whole optional add-on accessory (372,374,376, 378,380,382,384,390 FIGS. 16, 17), machines, formwork and materials would be placed as required. The SWP allows economical assembling, disassembling and transportation. Compared with the case of building up scaffolding to carry out the construction or maintenance, work efficiency is high, and cost can be considerably reduced. The members of the SWP are designed to be easily connected together for on-site completion, or can be pre-assembled and shipped complete to the job site.

SWP frame 100 has adjustable geometry and structure according to particular case and purposed use and is erected to the geometrical form of the structure 30. The dimensions and geometry of the SSS—Suspended Scaffolding System equipment varies in each particular case of use, adjusted to specific needs, the geometry of the structure to be work subject and the specific requirements of the work type to be carried out, for example:

For light maintenance jobs the working platform would be relatively long, as the work progress is quick, and used equipment is light (i.e. painting, cleaning . . . )

For the work to be carried in one particular place, the working platform would be relatively short (i.e. stressing . . . )

For formwork job type the working platform would be deep and high to cover the work area and carry the formwork equipment It is to be appreciated that these Figures are for illustration purposes only and other configurations are possible.

The invention has been described by way of several embodiments, with modifications and alternatives, but having read and understood this description further embodiments and modifications will be apparent to those skilled in the art. All such embodiments and modifications are intended to fall within the scope of the present invention as defined in the accompanying claims.

The invention claimed is:

1. A suspended scaffolding or form-work system comprises a connector system adapted to engage a fixture, the fixture in use is in contact with a first surface of a main stable structure, the suspended scaffolding or form-work system includes an arm that connects the suspended scaffolding or form-work system to the connector system so that in use the suspended scaffolding or form-work system is suspended below the main stable structure, wherein the suspended scaffolding or form-work system comprises at least one moveable counterweight provided below the main stable structure on the suspended scaffolding or form-work system, which is configured to be displaced from a first position to a second position configured to change a position of a center of gravity of the suspended scaffolding or form-work system, allowing the suspended scaffolding or form-work system to contact and be stabilized against a second surface of the main stable structure with the counterweight in the second position or hang freely with the counterweight in the first position or move freely along the fixture with the counterweight in the first position, wherein the first position is located relatively closer to a center of the suspended scaffolding or formwork system than the second position, wherein the first surface is disposed in a first plane and the second surface is disposed in a second plane which differs from the first plane.

2. The suspended scaffolding or form-work system according to claim 1 is configured to allow a mechanical or manual displacement of mass to displace the at least one counterweight in order to indicate a force pushing the suspended scaffolding or form-work system that safely stabilizes the suspended scaffolding or formwork system against the main stable structure.

3. The suspended scaffolding or form-work system according to claim 1 is configured to produce a stabilizing force and be stabilized against the main stable structure by adjusting the position of the center of gravity of the suspended scaffolding or form-work system away from a neutral position.

4. The suspended scaffolding or form-work system according to claim 1, wherein the first surface is disposed on a first side of the main stable structure, and the second surface is disposed on a second side of the main stable structure that is opposite from the first side.

5. The suspended scaffolding or form-work system according to claim 4, wherein the first side is a top side of the main stable structure and the second side is an underside of the main stable structure.

6. A method of stabilizing the suspended scaffolding or form-work system according to claim 1, the method comprising: providing the suspended scaffolding or form-work system of claim 1, adjusting the position of the center of gravity by moving the at least one counterweight via: swinging, translation, transposition, changing a distribution of weight in the at least one counterweight area by transferring a liquid or loose material from one ballast tank to another tank, or moving pieces of the at least one counterweight from one location to another location on the suspended scaffolding or form-work system.

* * * * *